US006003711A

United States Patent [19]

Bilewitz

[11] Patent Number: 6,003,711

[45] Date of Patent: Dec. 21, 1999

[54] DRINK THROUGH CAP FOR DRINKING CUP OR MUG

[76] Inventor: Leon Bilewitz, 8051 Simit La., Girard, Pa. 16417

[21] Appl. No.: 09/211,381

[22] Filed: Dec. 15, 1998

[51] Int. Cl.[6] ..... A47G 19/22; B65D 51/18

[52] U.S. Cl. ..... 220/253; 220/254; 220/713; 220/715

[58] Field of Search ..... 220/253, 715, 220/254, 256, 703, 711, 713, 714, 710.5; 222/548, 167, 153.14; D9/435, 447, 449

[56] References Cited

U.S. PATENT DOCUMENTS

| | | | |
|---|---|---|---|
| D. 355,846 | 2/1995 | Denney et al. | D9/449 |
| D. 373,927 | 9/1996 | Kramer et al. | D9/449 X |
| 3,874,580 | 4/1975 | Weatherhead, III . | |
| 4,057,167 | 11/1977 | Lee . | |
| 4,171,060 | 10/1979 | Howard et al. . | |
| 4,190,173 | 2/1980 | Mason et al. . | |
| 4,548,331 | 10/1985 | Montgomery | 220/253 |
| 4,579,245 | 4/1986 | Narushko . | |
| 4,611,725 | 9/1986 | Kacalieff . | |
| 4,657,139 | 4/1987 | Hanifl | 220/253 X |
| 4,792,054 | 12/1988 | Weidman . | |
| 4,846,374 | 7/1989 | Gabrys | 220/253 X |
| 5,123,574 | 6/1992 | Poulos | 220/253 X |
| 5,143,248 | 9/1992 | Sawatsky . | |
| 5,193,704 | 3/1993 | Kick | 220/253 |
| 5,205,430 | 4/1993 | Valyi | 220/253 X |
| 5,294,014 | 3/1994 | Wyatt et al. | 220/253 |
| 5,421,472 | 6/1995 | Beckertgis | 220/253 |
| 5,692,633 | 12/1997 | Gordon | 220/253 |
| 5,738,236 | 4/1998 | Brun, Jr. | 220/253 |

*Primary Examiner*—Allan N. Shoap
*Assistant Examiner*—Niki M. Eloshway
*Attorney, Agent, or Firm*—Charles L. Lovercheck; Wayne L. Lovercheck

[57] ABSTRACT

A drink through cap that removably attaches to a drinking cup or mug. The cap has a plate-like body with a drink through hole. A raised edge extends upwardly from the periphery of the body. A disk-shaped insert is rotatably supported on the body and has a drink through area that can be aligned with the drink through hole in the body for drinking and unaligned to prevent spilling. Tabs fixed to the insert extend over the raised edge of the body where they can be rotated to the raised open stop to align the holes for drinking, or rotated to the closed stops for nonalignment of the holes for safety. Further, the tabs can be placed over the open stops to provide a latched open condition and can be placed over the closed stops to provide a latched closed condition.

16 Claims, 5 Drawing Sheets

DRINK THROUGH CAP FOR DRINKING CUP OR MUG

BACKGROUND OF THE INVENTION

This invention relates to a beverage container, and more particularly to a combination of a thermally insulated beverage container having a cap with drink through hole. The drink through hole can be used to drink from the container and can be closed to prevent spilling the remaining liquid.

In the past, a variety of beverage containers have been utilized to thermally insulate hot or cold beverage. While these prior beverage containers have proved useful, there has remained a need for a transportable beverage container that provides an easily operated dispensing assembly that prevents leakage, spillage and is convenient to use for commuters and the like. To satisfy this requirement, the cap must be easily opened, easily closed and must be capable of being secured in an opened position and capable of being secured in a closed condition as well as capable of being easily changed from one condition to another.

Applicant is aware of the following U.S. Pat. Nos. 3,874,580; 4,057,167; 4,171,060; 4,190,173; 4,579,245; 4,611,725; 4,792,054; and, 5,143,2481.

U.S. Pat. No. 4,579,245 discloses a drink through lid having a movable flap 6 which may be moved to align holes 4, 7 to permit drinking and move them out of alignment to prevent spilling. No provision is made for retaining the holes in an aligned or unaligned position.

U.S. Pat. No. 5,143,248 discloses a removable closure cover for a drinking vessel. A drink through aperture and an inner cover is secured to the outer cover and selectively movable into opening or closing relation with the aperture. Again, there is no provision for restraining the apertures in or out of alignment with each other.

U.S. Pat. No. 4,057,167 provides a slide valve that moves into an open and closed position. This Patent discloses a releasable latch mechanism to secure the valve in its closed position. When the latch is released, the resilient member is moved into the open position by a resilient member such as a spring.

The prior art does not show a drink through lid having an opened condition, a closed condition, a secured opened condition and a secured closed condition.

SUMMARY OF THE INVENTION

The drinking cup disclosed herein may be used with an auto-type-drinking cup or any similar beverage container. The cap snaps firmly into position on a cup. The cap has a disk-shaped insert rotatably attached to it. The disk on the cap has a drinking opening that can be aligned with the drinking hole to provide a passage for the liquid to flow to a drinker. The disk is rotatable to a second position to close the hole to prevent spillage of the liquid. The disk shaped insert has spaced upwardly extending tabs that rest against the rim of the cap. The tabs may be rotated through a range between stops that extend upwardly from the rim of the cap. When the tabs are against the open stops, the cap is open for drinking. When the tabs are against the closed stops, the cap is closed to prevent spilling beverage. The tabs can be lifted up and onto the stops. When the open stops extend into the recesses in the underside of the top of the tabs, the cap is in a latched open condition. When the closed stops extend into the recesses in the underside of the top of the tabs, the cap is in a latched closed condition. The latched open and latched closed conditions assure that the condition will not change during handling for added safety to the drinker.

The present invention provides a cap for drinking from a cup. The outer skirt of the cap has an internal groove that snaps firmly into position under an external ring on the cup. The cap has a body that extends across the open end of a drinking vessel and has a drinking hole in it. The body has a rim with an inner skirt extending upwardly from the rim. The disk rests on the closure and is pivoted to the closure by a central hole and two diametrically spaced tabs are attached to the outer periphery of the disk. The tabs extend upwardly from the disk in contact with the inner skirt of the cap and extend outwardly and downwardly overlying the rim. The rim has stops extending upwardly therefrom which define the range through which the tabs are moved to change the condition of the cup from open to closed. The tabs can be grasped by the operator and move the disk from a closed position overlying the drinking hole to a position where the slot is located away from the drinking hole and the disk closes the drinking hole when the tabs are moved to a second position on the cap.

It is an object of the present invention to provide a drink through cap that by simple hand engagement, can be placed in an open condition, a closed position, a latched open condition and a latched closed condition.

It is another object of the present invention to provide a drink through cover for a drinking cup that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

Figure 3A:
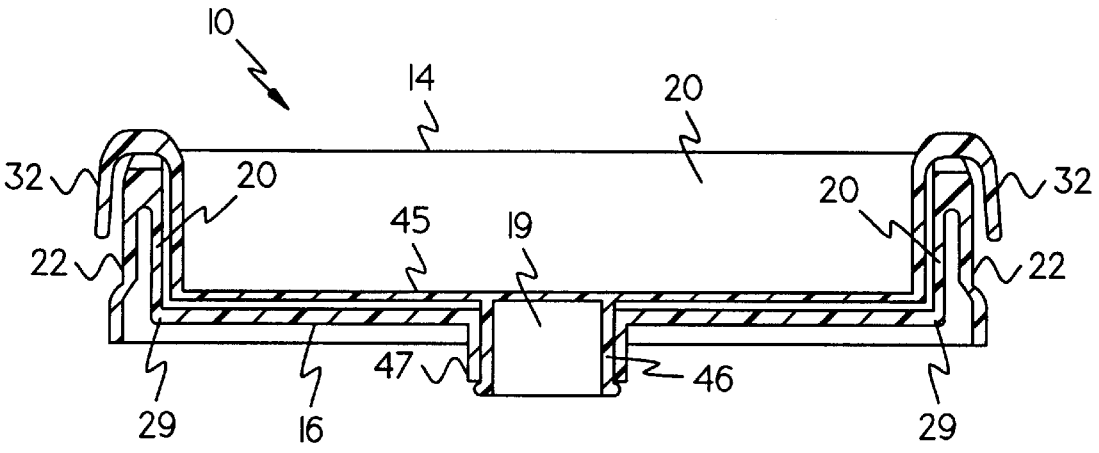
FIG. 3A is a cross sectional side view of the lid taken on line 2A—2A of FIG. 1 according to the invention.
Figure 3B:
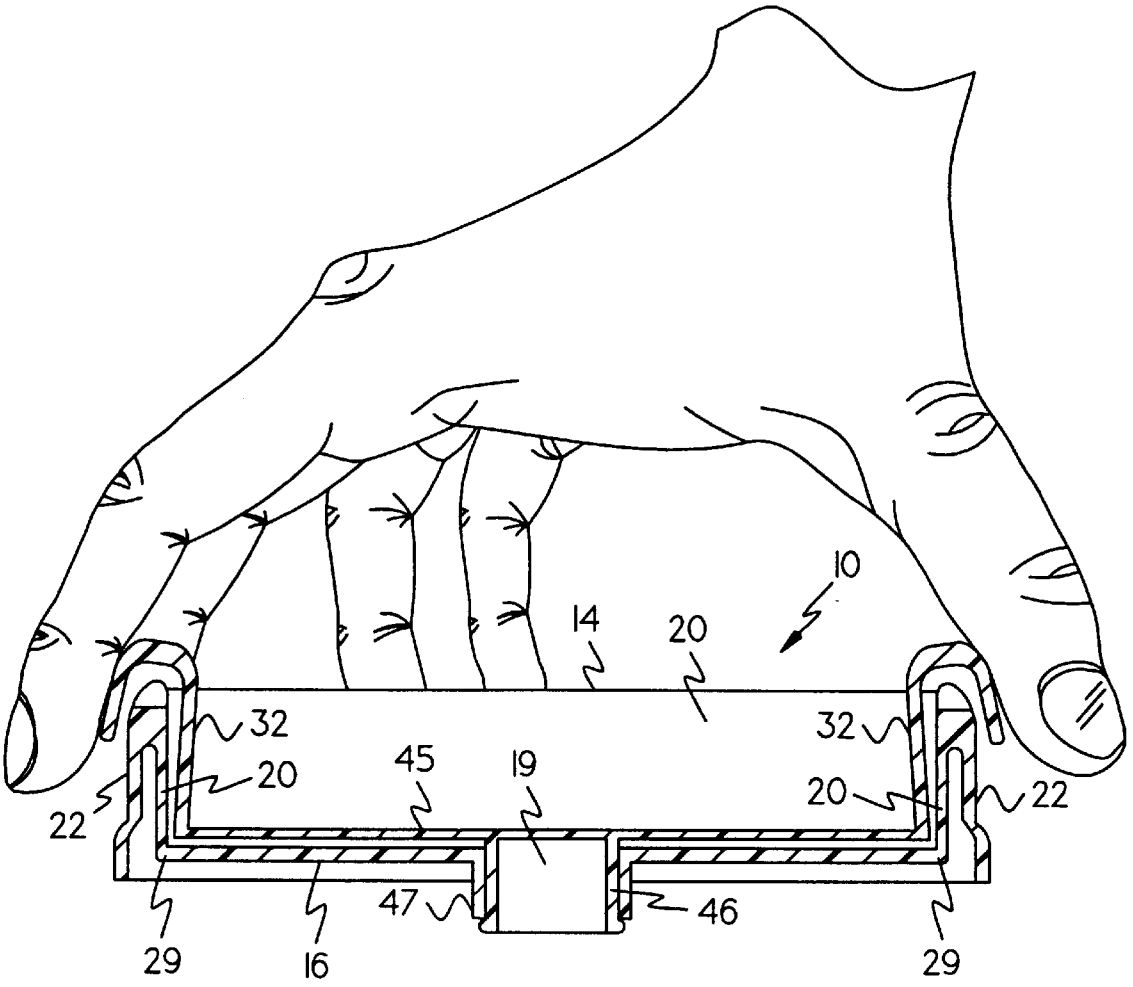

FIG. 3B is a cross sectional side view of the lid showing the tabs 32 moved to a raised position to place the tabs 32 over either the stop 36 to latch the lid in a drinking position or the tabs 38 to latch the lid in a closed position according to the invention.

Figure 1:
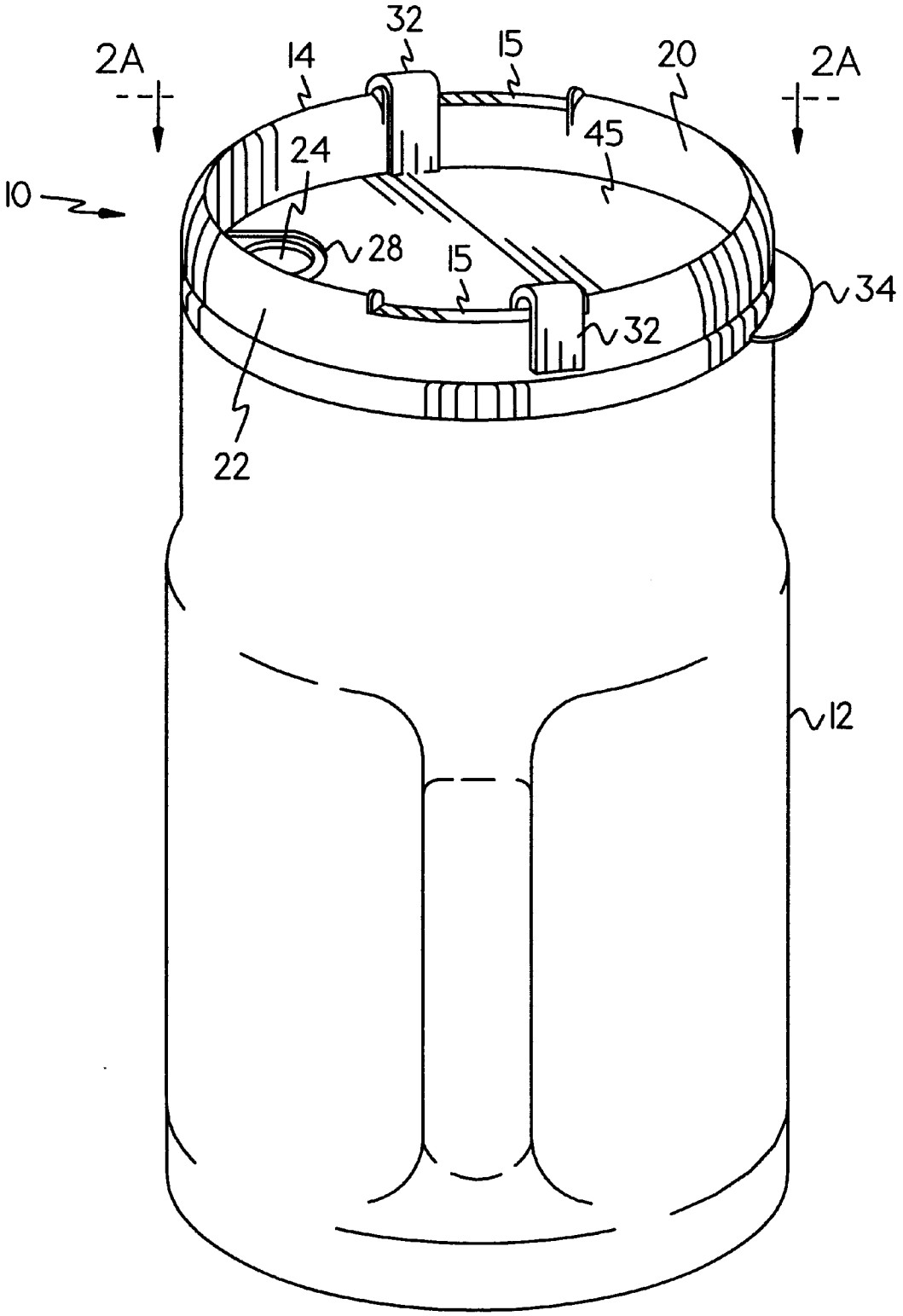
FIG. 1 is an isometric view of a drink through lid according to the invention with a drinking cup or mug shown in phantom lines.
Figure 2A:
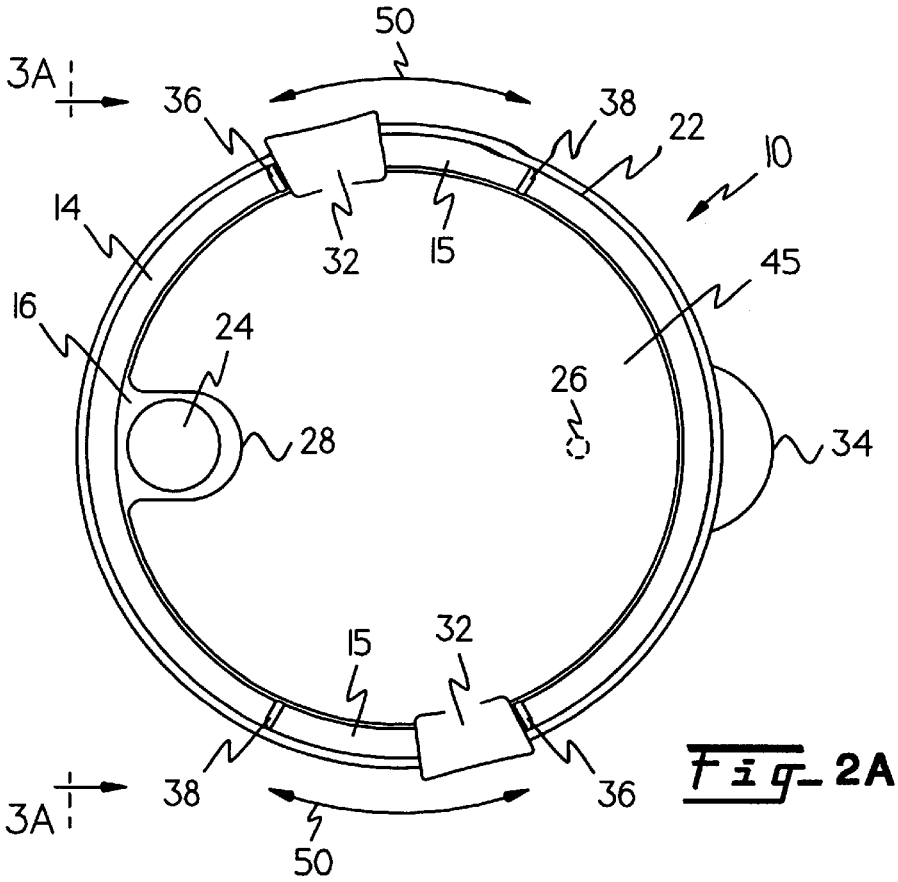
FIG. 2A is a top view of the drink through lid shown in FIG. 1 illustrated with the drinking hole and the drinking open aligned in the open position according to the invention.
Figure 2B:
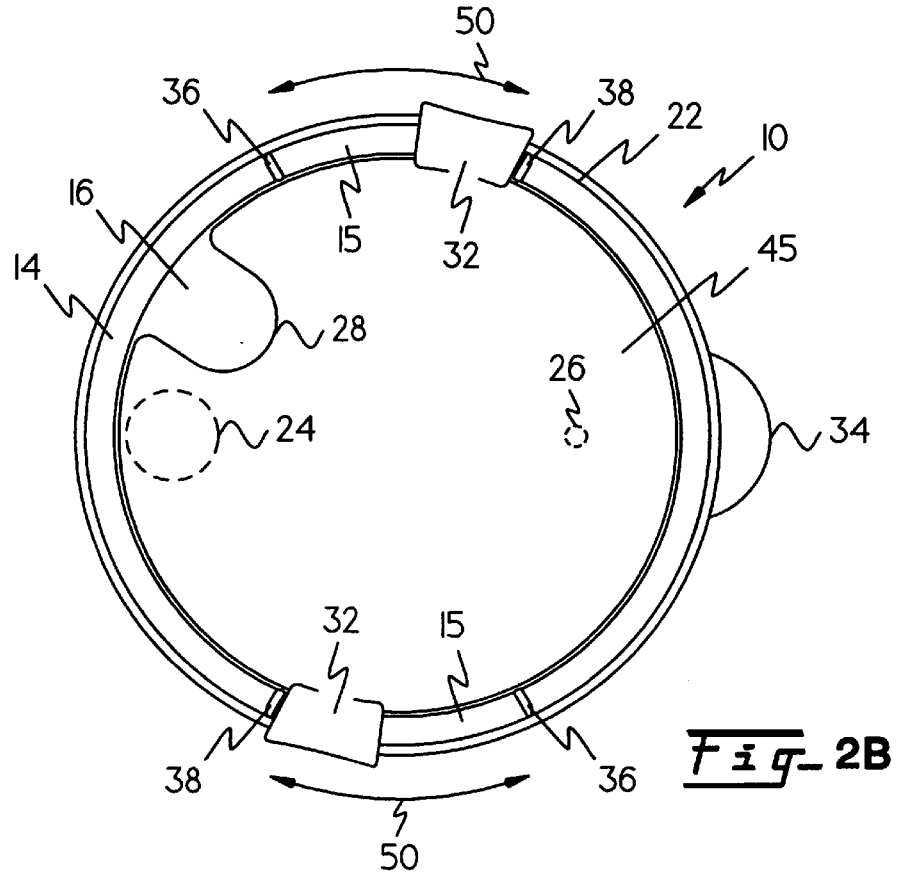
FIG. 2B is a top view of the drink through lid shown in FIG. 1 illustrated with the drinking hole and the drinking opening out of alignment in the closed position according to the invention.
Figure 4A:
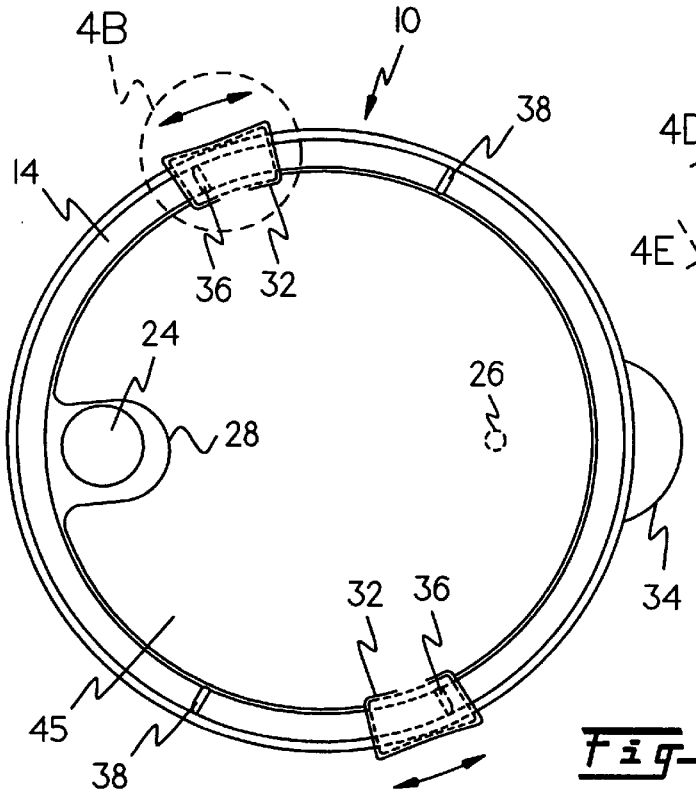

FIG. 4A is a top view of the drink through lid shown in FIG. 1 illustrated with the drinking hole and the drinking opening aligned in the latched open position with the tabs overlying the open position stops according to the invention.

Figure 4B:
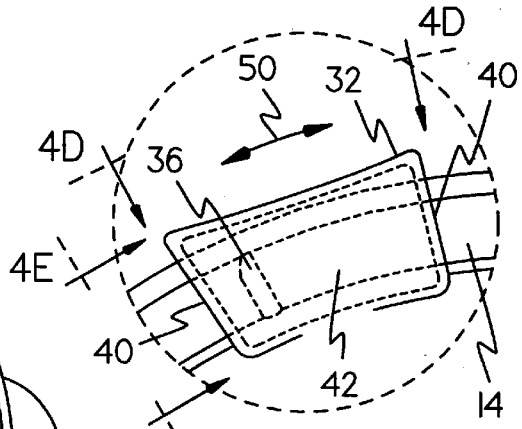

FIG. 4B is an enlarged partial view of FIG. 4A showing the stop in the recess in the tab according to the invention.

Figure 4C:
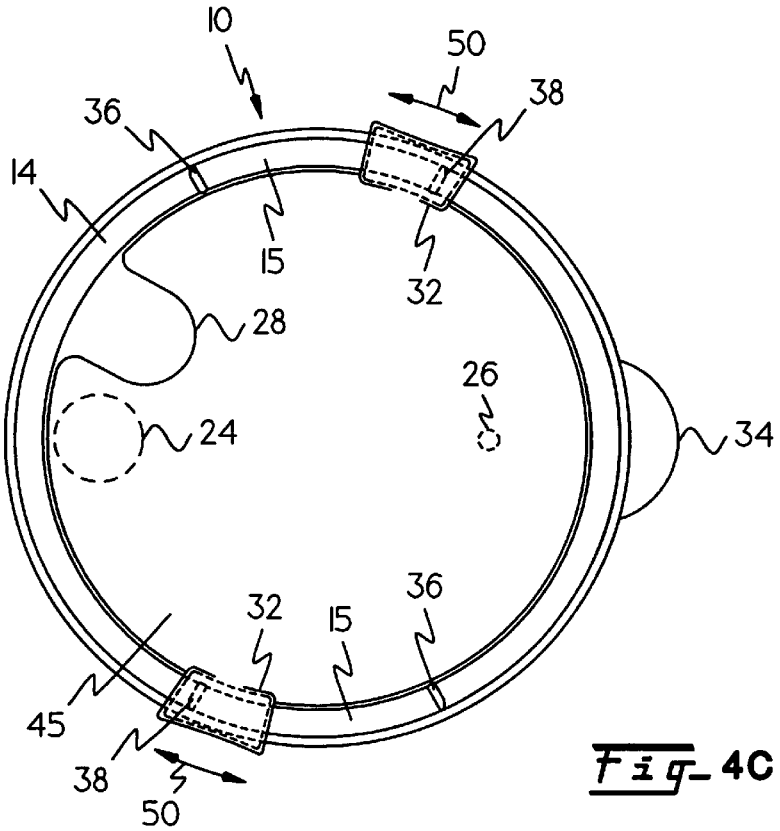

FIG. 4C is a top view of the drink through lid shown in FIG. 1 illustrated with the drinking hole and the drinking opening aligned in the latched closed position with the tabs overlying the closed position stops according to the invention.

Figure 4D:
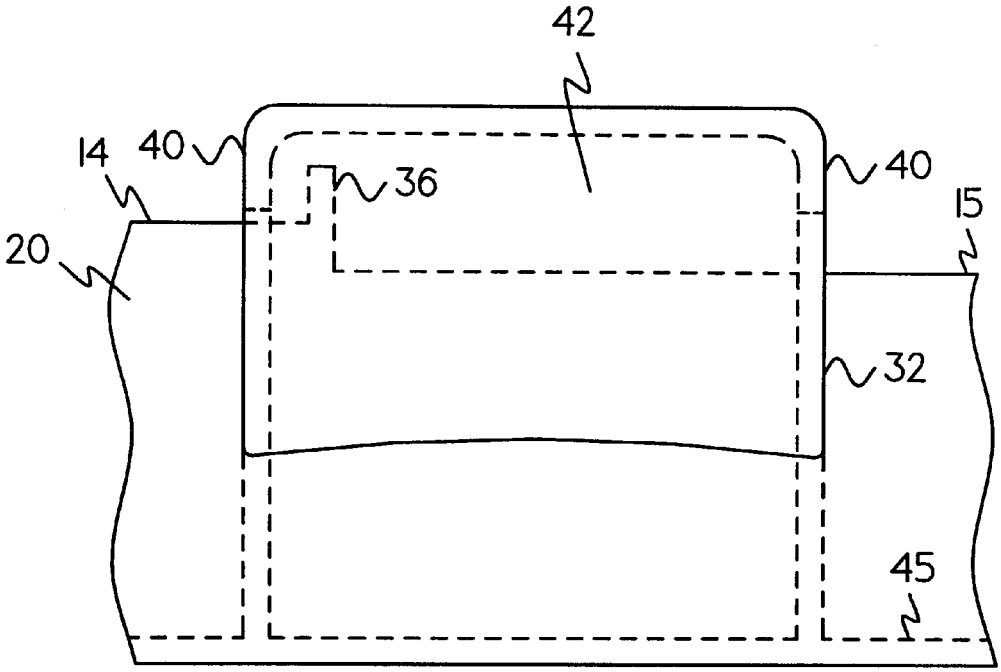

FIG. 4D is an enlarged cross sectional side view taken on line 4D—4D of FIG. 4B according to the invention.

Figure 4E:
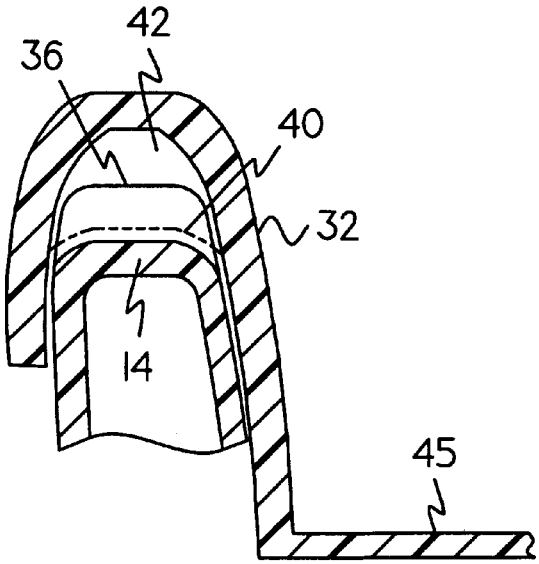

FIG. 4E is an enlarged partial cross sectional side view taken on line 4E—4E of FIG. 4B showing the recess in the tab according to the invention.

DESCRIPTION OF THE PREFERRED EMBODIMENT(S)

Now with more particular reference to the drawings, FIG. 1 shows cap 10 of the present invention removably attached to a cup or mug 12 illustrated in phantom lines.

FIGS. 1–4 show cap 10 having generally flat disk-shaped member 16 forming the body of cap 10. Member 16 has an outer periphery 29 that is integrally attached to the lower end of annular inner skirt 20. Annular skirt 20 extends generally upwardly to upper end 14. Upper end of generally annular outer skirt 22 and top of inner skirt 20 are integrally connected together at upper end 14. Outer skirt 22 extends generally downwardly from upper end 14 terminating at a distal end that may be adapted to engage the upper end of a cup or mug in a manner well known in the art.

Disk-shaped insert 45 is a generally flat disk-shaped member that fits inside the hollow cylinder formed by inner skirt 20. Insert 45 is generally rotatable within the inner skirt 20 and generally overlies disk-shaped member 16. Insert 45 is supported by support ring 46. Support ring 46 is integrally attached to the center of the underside of insert 45 and extends downwardly through central hole 19 which extends through disk-shaped member 16 and support boss 47. Support boss 47 is integrally attached to the underside of member 16. Support ring 46 snap fits into support boss 47 and is rotatably supported therein. Finger engaging tabs 32 are integrally attached to the outer edge of insert 45. Hole 19 extends through disk-shaped member 16 and support boss 47. Open stops 36 and closed stops 38 are spaced from each other and fixed to cap 10. The drink through feature is facilitated in this cap with the recessed area of the upper surface of insert 45 surrounded by the raised enclosure of inner shirt 20 and outer shirt 22. When drink through hole 24 in the disk-shaped member is aligned with the drinking area 28 in the disk-shaped insert 45, the contents of the cup can be consumed through the lid. When the drink through hole 24 and the drinking area 28 are out of alignment, the lid is closed and the contents cannot be consumed through the lid. Slide areas 15 are formed between open stops 36 and closed stops 38. Open stops 36 and closed stops 38 are integrally attached to the upper end and extend upwardly therefrom. The open stops 36 and closed stops 38 are placed at each end of the slide areas 15. The tabs 32 are slid from open position adjacent open stops 36 through the slide area 15 to closed position against stops 38. Tabs 32 are diametrically spaced from each other and are integrally attached to the outer peripheral edge of disk-shaped insert 45. Tabs 32 extend upwardly and outwardly along inner skirt 20, extends across upper end 14 and then extend downwardly over at least a portion of the height of outer skirt 22.

Tabs 32 are generally diametrically spaced from each other and are integrally attached to the outer peripheral edge of disk-shaped insert 45.

Tabs 32 extend upwardly and outwardly above inner skirt 20 and downward over outer skirt 22. Tabs 32 can be moved by hand engagement upwardly and then rotated to a position over the open stops 36, and then lowered on stops 36. Stops 36 enter a recess 42 in the tops of tabs 32 formed by recess sides 40 and upper ends of tabs 32. When the tabs 32 have the stops 36 confined in the recesses 42, the cap is in a latched open condition and the drink through hole 24 and the drinking area 28 will remain open and aligned for drinking until it is unlatched by finger engagement lifting tabs 32 until stops 36 are clear and rotating insert 45 to a position in the slide area 15.

In a similar manner, tabs 32 can be moved upwardly by hand engagement and then rotated to a position over the closed stops 38, and then lowered onto stops 38. Stops 38 enter recesses 42 in the tops of tabs 32 formed by recess sides 40 and the upper ends of tabs 32. When tabs 32 have stops 38 confined in recesses 42, the cap is in a latched closed condition and the drink through hole 24 and drink area 28 will remain closed and out of alignment for drinking until it is unlocked by finger engagement lifting the tabs 32 until stops 38 are clear and rotating insert 45 to a position in slide area 15.

Thus, the cup lid provides for four conditions: open for drinking; closed to drinking; latched open for drinking; and, latched closed for transporting.

Thumb tab 34 is integrally attached to outer skirt 20 to be engaged to assist in securing cap 10 to cup 12 or in removing cap 10 from cup 12.

Vent hole 26 is provided through disk-shaped member 16 to facilitate drinking through drink hole 24. A corresponding hole through disk-shaped insert 45 may be provided. However, unless the fit of the insert 45 against the inner shirt 20 is tight, a vent hole through the insert is not necessary.

The slide areas 15 may be recessed relative to the upper surface of upper end 14.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A drink through cap comprising:

a cap body having a generally flat surface, a skirt extending upwardly from the periphery of said flat surface, and an upper edge extending from said skirt;

a drinking hole in said cap body;

a disk having a relatively flat surface and being rotatably supported on said cap body adjacent said flat surface;

a drinking area in said flat surface of said disk;

a first open stop extending upwardly from said upper edge of said cap body and a first closed stop on said cap body spaced from said first open stop;

a first stop means extending upwardly from said disk and being disposed between said first open stop and said first closed stop;

said disk being rotatable on said cap body to bring said first stop means into engagement with said first open stop to position said drinking area over said drinking hole whereby said cap is in open condition; and, said disk being rotatable to bring said first stop means into engagement with said first closed stop to position said drinking area remote from said drinking hole whereby said cap is in a closed condition.

2. The drink through cap recited in claim 1 wherein said upper edge has a second open stop extending upwardly therefrom and a second closed stop on said cap body spaced from said second open stop a second stop means extending upwardly from said disk and being disposed between said second open stop and said second closed stop;

said disk being rotatable on said cap body to bring said second stop means into engagement with said second open stop to position said drinking area over said drinking hole whereby said cap is in an open condition; and, said disk being rotatable to bring said second stop means into engagement with said second closed stop to position said drinking area remote from said drinking hole whereby said cap is in a closed position.

3. The drink through cap recited in claim 2 wherein said first open stop, second open stop, first closed stop and second closed stop being disposed around a perimeter of said flat surface and projecting upwardly from the upper edge of the cap body.

4. The drink through cap recited in claim 2 wherein said first stop means comprises a first tab fixed to said disk and being rotatable therewith; and, said second stop means being spaced from said first stop means and comprises a second tab fixed to said disk and being rotatable therewith.

5. The drink through cap recited in claim 4 wherein said first tab and said second tab have a recess therein accessible from an under side; and, said first open stop, second open stop, first closed stop and said second closed stop are disposed around a perimeter of said flat surface and project upwardly from the upper edge of the cap body.

6. The drink through cap recited in claim 5 further having an open latching means comprising said first tab receiving said first open stop in said first recess and said second tab receiving said second open stop in said second recess.

7. The drink through cap recited in claim 5 further having a closed latching means comprising said first tab receiving said first closed stop in said first recess and said second tab receiving said second closed stop in said second recess.

8. The drink through cap recited in claim 4 wherein said tabs are diametrically spaced from each other on said disk.

9. The drink through cap recited in claim 1 wherein said cap body has a central opening and said disk has a central hub received in said opening whereby said disk is rotatably supported on said cap body.

10. A drink through cap for a cup comprising:

a cap body having a generally flat surface;

a drinking hole extending through said cap body adjacent an outer edge thereof;

a disk having a relatively flat surface and being generally coextensive with said cap body;

said disk being rotatably supported on and adjacent to said cap body;

a drinking area extending through said disk adjacent an outer edge thereof;

a raised inner skirt being integrally attached to the edge of the cap body and extending upwardly therefrom;

an outer skirt extending generally around said inner skirt;

an upper edge being integrally attached to said inner skirt and said outer skirt at the upper ends thereof;

a first open stop and a first closed stop spaced from each other on said upper edge and extending upwardly therefrom;

a second open stop and a second closed stop spaced from each other on said upper edge and extending upwardly therefrom;

a first stop means and a second tab means integrally attached to said rotatable disk and extending generally upwardly therefrom;

said first stop means being positionable to engage said first open stop and said first closed stop;

said second stop means being positioned to engage said second open stop and said second closed stop whereby when said disk is rotated to bring said first stop means into engagement with said first open stop and said second stop means into engagement with said second open stop;

said drinking area is positioned over said drinking hole and said cap is in an open position; and, when said disk is rotated to bring said first stop means into engagement with said first closed stop and said second stop means into engagement with said second closed stop, said drinking area is positioned remote from said drinking hole and said cap is in a closed condition.

11. The drink through cap recited in claim 10 wherein said first stop means comprises a first tab that extends generally upwardly from the outer edge of the disk along said inner skirt to the upper end thereof, said first stop continues to extend generally across said upper edge, and continues generally downwardly along at least a part of said outer skirt; and, said second stop means comprises a second tab that extends generally upwardly from the outer edge of the disk along said inner skirt to the upper end thereof, said second stop continues generally across said upper edge end, and continues generally downwardly along at least a part of said outer skirt.

12. The cap recited in claim 11 wherein said first tab has a recess which overlies the upper edge; and, said second tab has a recess that overlies said upper edge.

13. The drink through cap recited in claim 11 wherein said disk covers said drinking hole when said disk is in said closed condition.

14. The drink through cap recited in claim 13 wherein said disk is rotatably supported on said cap body;

said first tab and said second tab can be hand engaged to rotate said disk;

said disk can be rotated from an open position to a closed position;

said first tab and said second tab can be placed over said first open stop and said second open stop to provide a latched open condition; and, said first tab and said second tab can be placed over said first closed stop and said second closed stop to provide a latched closed condition.

15. The drink through cap recited in claim 10 comprising a first lowered area in said upper edge and a second lowered area in said upper edge;

said first lowered area having said first open stop and said first closed stop at each end thereof;

said second lowered area having said second open stop and said second closed stop at each end thereof.

16. The drink through cap recited in claim 10 wherein said open stops and said closed stops are received in recesses in said first stop means and said second stop means.

* * * * *